US005111615A

United States Patent [19]

Kuhnt et al.

[11] Patent Number: 5,111,615

[45] Date of Patent: May 12, 1992

[54] WINDOW WITH PIVOTABLE SASH AND MECHANISM FOR LOCKING THE SASH IN CLOSED POSITION

[75] Inventors: Erhard Kuhnt, Heiligenhaus; Karl-Heinz Dreifert, Velbert, both of Fed. Rep. of Germany

[73] Assignee: Wilhelm Weidtmann GmbH & Co. KG, Velbert, Fed. Rep. of Germany

[21] Appl. No.: 685,555

[22] Filed: Apr. 15, 1991

[30] Foreign Application Priority Data

Apr. 14, 1990 [DE] Fed. Rep. of Germany ..... 4012234
Mar. 26, 1991 [DE] Fed. Rep. of Germany ..... 4109852

[51] Int. Cl.[5] ..... E05F 11/02
[52] U.S. Cl. ..... 49/279; 49/13; 49/394
[58] Field of Search ..... 49/279, 280, 394, 300, 49/13, 252

[56] References Cited

U.S. PATENT DOCUMENTS

| | | | |
|---|---|---|---|
| 2,114,645 | 4/1938 | Benschoten | 49/279 |
| 2,366,613 | 1/1945 | Hagstrom | 49/252 |
| 4,497,135 | 2/1985 | Vetter | 49/280 |
| 4,617,758 | 10/1986 | Vetter | 49/279 X |
| 4,887,392 | 12/1989 | Lense | 49/300 |

FOREIGN PATENT DOCUMENTS 0323241 7/1989 European Pat. Off. .

*Primary Examiner*—Philip C. Kannan
*Attorney, Agent, or Firm*—Peter K. Kontler

[57] ABSTRACT

A casement window wherein the sash is pivotable in the frame about a vertical axis has a self-locking crank drive which pivots the sash between open and closed positions by way of a pivotable lever, a link which is coupled to the lever, and an actuator which is movably installed in the sash, which is coupled to the link and which forms part of a locking-unlocking mechanism for the sash. The first stage of rotation of the crank drive in order to pivot the sash from closed position involves a displacement of the actuator which ensures that the sash is unlocked, and further rotation of the crank drive results in pivoting of the sash to the open position. If the direction of rotation of the crank drive is reversed, the sash is moved to the closed position before the actuator is caused to lock the sash to the frame. A blocking device for the actuator is operated by the frame to release the actuator for movement to its operative position shortly before the sash reaches the closed position. To this end, a mobile blocking element of the blocking device is installed in the sash and is displaced by the frame before the sash reassumes its closed position whereby the blocking element releases the actuator which is held in the inoperative position while the sash is held in an open or partly open position.

37 Claims, 12 Drawing Sheets

FIG. 8
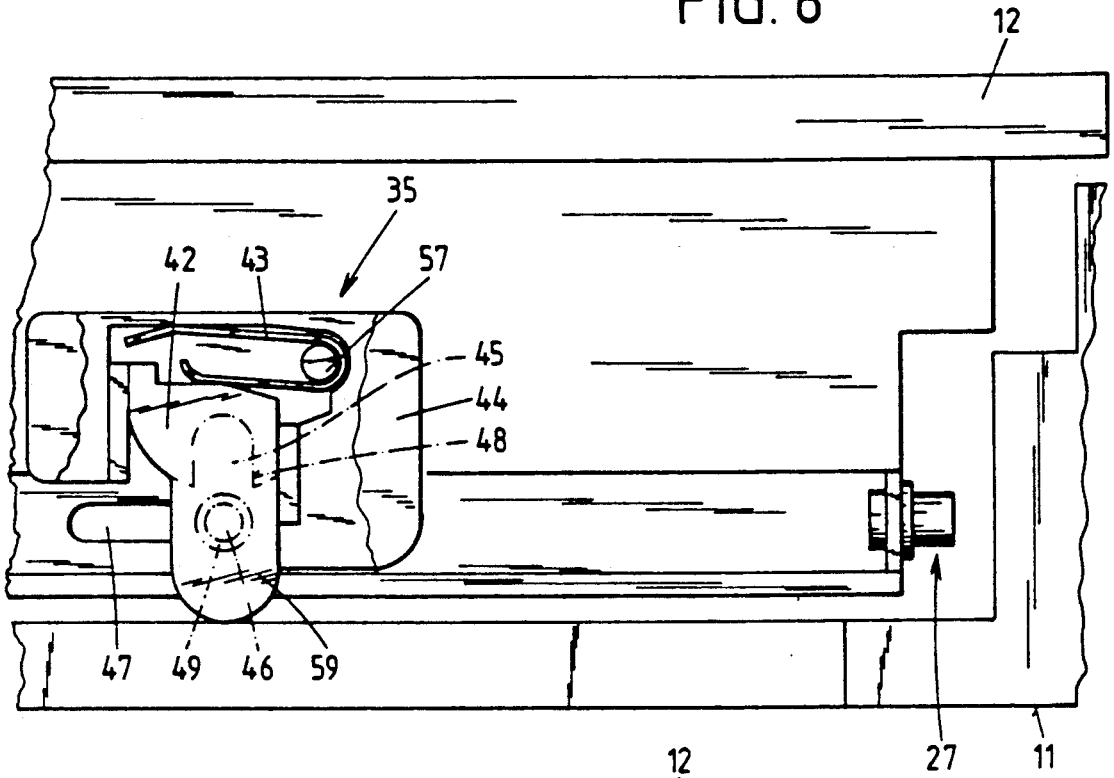
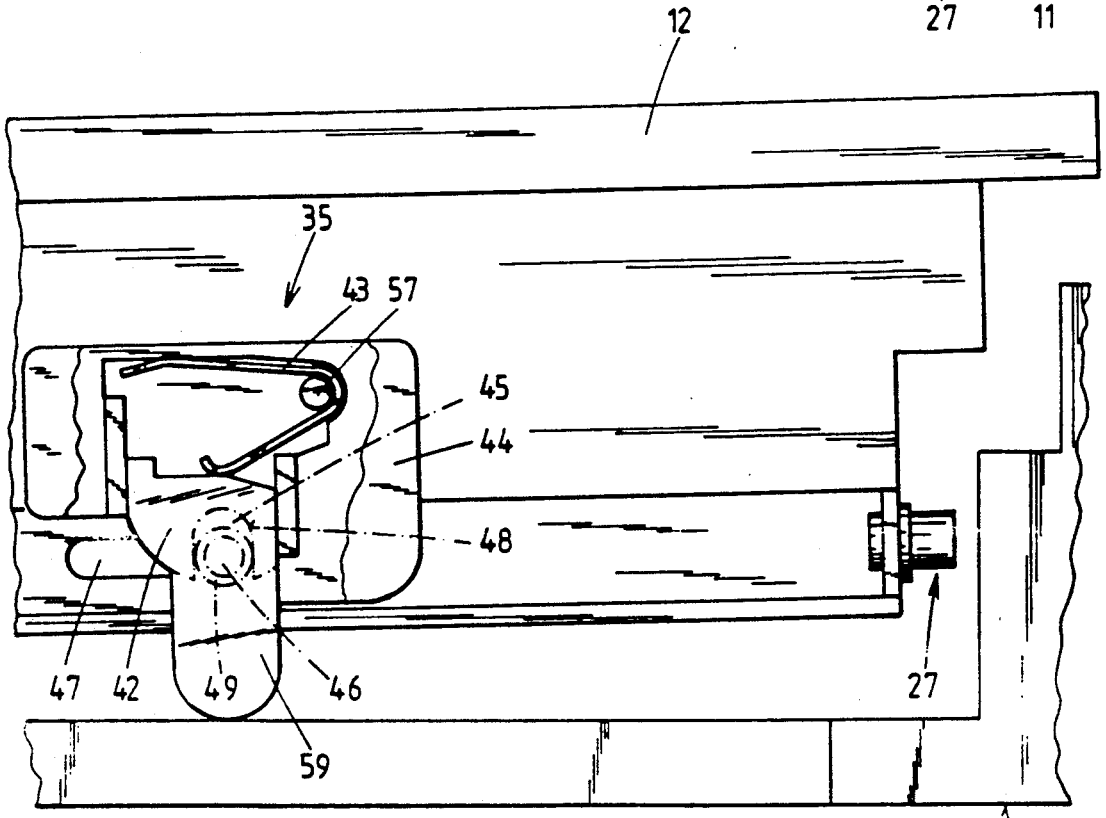
FIG. 9

FIG. 10
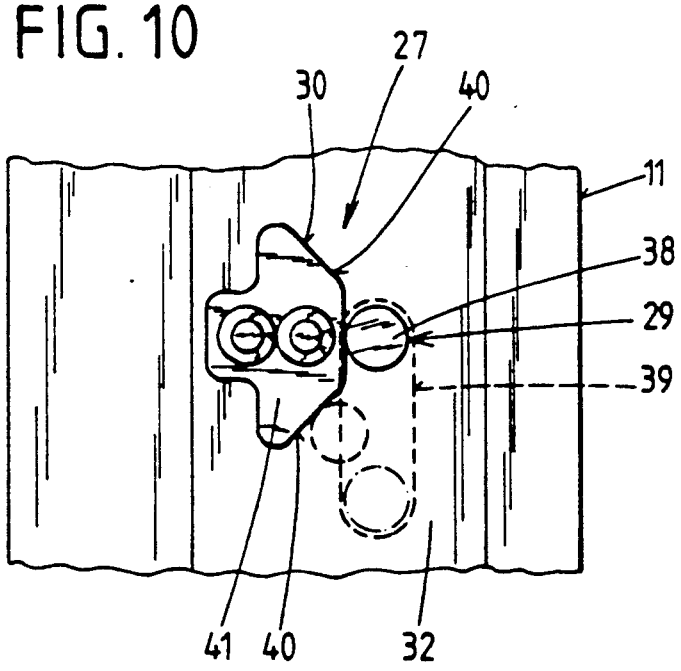
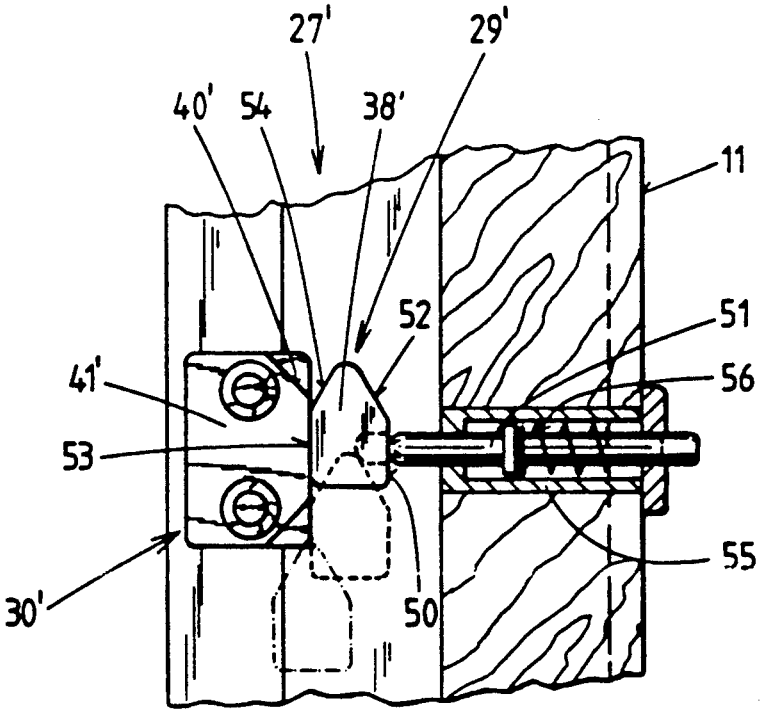
FIG. 11

WINDOW WITH PIVOTABLE SASH AND MECHANISM FOR LOCKING THE SASH IN CLOSED POSITION

BACKGROUND OF THE INVENTION

The invention relates to windows in general, and more particularly to improvements in casement windows. Still more particularly, the invention relates to improvements in casement windows wherein the sash can be releasably arrested or locked in closed position.

It is already known to provide the frame and the sash of a casement window with cooperating stationary and mobile detents and with an actuator which can move the mobile detents into engagement with the adjacent stationary detents in closed position of the sash. This ensures that the sash remains in closed position until and unless the arresting or locking device is deactivated by moving the actuator and the mobile detents to inoperative positions. As a rule, or at least in many instances, the sash is pivotably mounted in the window frame (e.g., on pairs of links) in such a way that it moves outwardly (beyond the outer side of the frame) during pivoting to its open position. The drive which must be manipulated to pivot the sash is provided with a self-locking transmission which ensures that the sash remains in a selected position except when an operator decides to manipulate the drive in a sense to move the sash to the closed position, to the fully open position, or to any one of a number of intermediate positions. Thus, the angular position of the sash cannot be changed by exerting a pulling or pushing force directly against the sash; this ensures that gusts of wind cannot change the selected position of the sash. The locking device not only secures the sash in the closed position but also ensures that the border of the sash is in proper engagement with the adjacent portions of the frame so that the customary weatherstripping between the frame and the sash is fully effective as soon as the sash moves to and as long as the sash remains in closed position. Proper engagement of the sash with the frame is particularly desirable and important along the two vertical jambs of the frame.

The actuator for the mobile detents of the locking or arresting device is normally recessed into a groove in the border of the sash. In heretofore known windows, the actuator is moved between operative and inoperative positions by a handle which is provided on the sash, i.e., by a handle which does not form part of the aforementioned drive serving to pivot the sash between its open and closed positions. Thus, the operator in charge must manipulate the handle to move the actuator and the mobile detents to inoperative positions prior to manipulation of the drive which is to pivot the sash from the closed position. Inversely, the drive must be manipulated first in order to return the sash to the closed position, and the handle is manipulated thereafter to return the actuator and the mobile detents to their operative positions.

Published European patent application No. 0 323 241 discloses a casement window wherein the sash is caused to pivot outwardly beyond the outer side of the frame during movement from closed to open position. This publication further discloses a crank drive which can be used to pivot the sash as well as to move an actuator of the locking or arresting device between operative and inoperative positions. The crank drive is directly coupled to the actuator which forms part of the locking device and is recessed into a groove which is provided in the frame. The actuator extends along that portion of the sash which is remote from the hinge for the sash. Thus, the locking device which is disclosed in this publication is designed to lock the sash to the frame only along one jamb of the frame so that the establishment of a reliable sealing action between the frame and the sash (in the closed position of the sash) is highly unlikely The actuator cannot be caused to surround a major part of the sash because it is installed in the frame. Such mounting prevents the actuator from extending along one or more corners of the frame because this would interfere with movements of the sash to the closed position.

OBJECTS OF THE INVENTION

An object of the invention is to provide a window wherein the sash can be reliably locked to the frame at any desired number of locations and the locking device can be operated by the drive which is used to move the sash between open and closed positions.

Another object of the invention is to provide a window wherein the locking device for the sash can be deactivated as long as the sash remains out of the closed position to thus prevent untimely operation of the locking device.

A further object of the invention is to provide a window wherein a single handle suffices to initiate all movements which are needed to effect movements of the sash to and from closed position as well as for operating the locking device for the sash.

An additional object of the invention is to provide the window with a novel and improved locking device for the sash.

Still another object of the invention is to provide a novel and improved connection between the drive for the sash and the locking device in the above outlined window.

A further object of the invention is to provide a novel and improved mechanism which can prevent operation of the locking device in the open or partly open position of the sash.

Another object of the invention is to provide a blocking mechanism whose operation is automated so that it need not be monitored by the person in charge of opening or closing the sash.

An additional object of the invention is to provide a simple and inexpensive window which ensures the establishment of a satisfactory sealing action as soon as the sash is returned to closed position.

A further object of the invention is to provide a novel and improved method of synchronizing the operation of the drive for the sash with the operation of the locking device for the sash.

Still another object of the invention is to provide a window wherein the condition of the locking device can be observed at all times.

A further object of the invention is to provide a window wherein the blocking action upon the locking device can be adjusted to ensure predictable and automatic retention of the locking device in the inoperative position, as long as the sash is away from the closed position.

SUMMARY OF THE INVENTION

The invention is embodied in a window which comprises a frame, a sash which is movable relative to the frame between open and closed positions (such movement preferably involves pivoting of the sash about a vertical axis (if the window is mounted in a vertical plane), means for movably securing the sash to the frame, means for moving the sash relative to the frame, an arresting device which has a mechanism for locking and unlocking the sash in the closed position of the sash, means for coupling the arresting device with the moving means to unlock the sash prior to movement of the sash from the closed position and to lock the sash upon return movement to the closed position, and means for blocking the locking and unlocking mechanism in response to movement of the sash from the closed position.

In accordance with a presently preferred embodiment, the moving means includes a crank drive which can be installed in the bottom member of the frame, and a lever which is pivotable by the crank drive. The coupling means preferably includes a motion transmitting member (such as an elongated link) and means for articulately connecting the motion transmitting member with the lever and with the arresting device.

The mechanism for locking and unlocking the sash preferably comprises at least one first detent on the frame, at least one second detent which is movably mounted on the sash, and an actuator which is connected with and is movable by the motion transmitting member of the coupling means between operative and inoperative positions to respectively engage the second detent with and disengage the second detent from the first detent in the closed position of the sash. The crank drive is operable to move the actuator to its inoperative position by way of the lever and the motion transmitting member prior to moving the sash from the closed position, and to move the sash back to the closed position prior to moving the actuator to its operative position. The sash can comprise or carry means for confining the actuator to movements between its operative and inoperative positions. To this end, the sash can comprise a cover for the actuator (the latter can be installed in a groove which is provided in the border of the sash and is overlapped by the cover), and the connecting means can comprise a pivot which connects the motion transmitting member with the actuator. The cover has a slot for the pivot, and the slot of the cover is designed to confine the pivot to movements between first and second positions which respectively correspond to the operative and inoperative positions of the actuator.

The at least one second detent can comprise a follower which is provided on the actuator, and the cover for the actuator can be provided with an additional slot through which the follower extends and which permits movements of the actuator and of the follower relative to the cover between operative and inoperative positions.

The at least one first detent can comprise a cam which is provided on the frame and has a face which is tracked by the follower of the second detent during movement of the actuator between operative and inoperative positions.

The window can further comprise means for indicating the positions of the actuator. The indicating means can comprise a component (e.g., a reciprocable pin or stud) which is movable by the second detent to assume a predetermined position in response to movement of the actuator to the operative or inoperative position. The indicating means can further comprise a coil spring or other suitable means for biasing the component from the predetermined position, and the second detent can be provided with a cam face which is tracked by a portion of the component. The tracking portion of the component engages a predetermined portion of the cam face in the operative or inoperative position of the actuator. The component is observable in the predetermined position, or such component can be used to actuate a visible, audible and/or otherwise detectable alarm in the operative or inoperative position of the actuator.

The blocking means can comprise a blocking element which is provided on the sash and is movable to and from a blocking position in which the actuator is held in the inoperative position. The blocking element is moved from the blocking position by the frame in response to movement of the sash to the closed position so that the actuator can be moved by the drive to assume its operative position as soon as or while the sash assumes the closed position. The sash can be provided with means for limiting the extent of movability of the blocking element from the blocking position.

The blocking means preferably further comprises a housing which is provided on or in the sash and movably receives the blocking element. The latter can be provided with a protuberance (such as a tongue or a prong) which extends from the housing and engages the frame while the sash approaches and continues to move toward the closed position whereby the frame moves the blocking element from the blocking position to permit a movement of the actuator to the operative position. The blocking means preferably also comprises means for biasing the blocking element to the blocking position, i.e., the blocking element is compelled to automatically assume the blocking position, as a result of disengagement of the protuberance from the frame, in response to movement of the sash from the closed position. The biasing means can comprise a leaf spring or a torsion spring which reacts against the housing and bears against the blocking element. If the biasing means comprises a torsion spring, the latter can be fulcrumed in the housing and can include a first portion or leg which reacts against the housing (i.e., against the sash) as well as a second portion or leg which bears against the blocking element. Alternatively, the biasing means can comprise at least one coil spring. The arrangement may be such that, if the blocking element is reciprocable to and from the blocking position and the biasing means comprises one or more coil springs, the axis or axes of such coil spring or springs preferably extend in substantial parallelism with the direction of reciprocatory movement of the blocking element.

A pin-and-socket connection can be provided between the actuator and the blocking element, and such connection is operative or effective in the blocking position of the blocking element. The arrangement is or can be such that the connection comprises a pin on the actuator and a socket in the blocking element. The socket can be constituted by a slot which has an open end facing the frame in the closed position of the sash. The slot preferably extends in the direction of preferably reciprocatory movement of the blocking element to and from the blocking position. Instead of constituting an open-ended slot in the blocking element, the socket can constitute a recess or cutout in the blocking element.

The blocking means for the locking-unlocking mechanism can comprise a composite blocking element having a first pawl which is pivotably mounted in or on the sash and has a socket, and a second pawl which is pivotably mounted in or on the sash and has a portion engageable by the frame during movement of the sash toward the closed position whereby the frame pivots the second pawl from a first to a second position. The pin of the actuator is movable into and out of the socket of the first pawl in a first position of the first pawl so that the actuator is free to move toward and from the operative position. The pawls comprise cooperating teeth, cams of analogous portions which maintain the first pawl in a second position in the first position of the second pawl, and the blocking means further comprises means for biasing the pawls to their first positions.

The first pawl is pivotable from the first to the second position by the pin of the actuator in response to movement of the actuator from the operative to the inoperative position, and the aforementioned portions of the two pawls then cooperate to maintain the first pawl in the second position (and to thus block the actuator in the inoperative position) in the first position of the second pawl (i.e., when the sash is not in the closed position).

The blocking means can further comprise a housing for the pawls and their pivot members. The housing is provided in or on the sash and preferably includes a stop which is engaged by the first pawl under the action of the biasing means in the first position of the first pawl. The first pawl can constitute a flat plate-like body which has an edge face engaging the stop of the housing in the first position of the first pawl. The pawls preferably comprise retainers, and the biasing means can comprise a coil spring having spaced-apart portions connected to the retainers of the two pawls.

The border of the sash is adjacent the frame in the closed position of the sash, and the housing for the mobile blocking element of the blocking means is preferably installed in such border of the sash. The housing is preferably remote from the means for securing the sash to the frame.

The extended position of the blocking element of the blocking means (the blocking element assumes such extended position under the bias of the aforediscussed spring or springs and is moved from the extended position by the frame in automatic response to movement of the sash toward its closed position) can be selected by suitable adjusting means to ensure that the blocking element can be properly engaged and adequately displaced by the frame and can be properly positioned to block the actuator of the locking-unlocking mechanism for the sash as soon as the sash leaves the closed position. The means for adjusting the extended position of the blocking element preferably comrpses a stop for the blocking element (i.e., the aforediscussed protuberance of the reciprocable blocking element of for the second pawl of the composite blocking element), and means for adjusting the stop relative to the frame. The means for adjusting the stop can include means for locating the stop in any one of an infinite number of different positions relative to the frame, and such locating means can comprise a rotary threaded member (e.g., a bolt) which meshes with the frame and constitutes an anvil or abutment for the stop. Alternatively, the means for adjusting the stop can include means for locating the stop in any one of a finite number of different positions. Such locating means can comprise disengageable mating serrated or toothed sections one of which is provided on the stop and the other of which is provided on the frame.

The stop can be mounted on or can form part of a springy carrier (e.g., a metallic leaf spring) which is provided on the frame.

The novel features which are considered as characteristic of the invention are set forth in particular in the appended claims. The improved window itself, however, both as to its construction and the mode of operating the same, together with additional features and advantages thereof, will be best understood upon perusal of the following detailed description of certain presently preferred specific embodiments with reference to the accompanying drawing.

BRIEF DESCRIPTION OF THE DRAWING

FIG. 8 is a sectional view substantially as seen in the direction of arrows from the line VIII—VIII in FIG. 6;

FIG. 9 is a sectional view substantially as seen in the direction of arrows from the line IX—IX in FIG. 7;

FIG. 10 is an enlarged vertical sectional view substantially as seen in the direction of arrows from the line X—X in FIG. 1 and shows a portion of the locking-unlocking mechanism which is used in the window of FIGS. 1 to 5;

FIG. 11 is a sectional view similar to that of FIG. 10 but showing a portion of a modified locking-unlocking mechanism and means for indicating the condition of the locking-unlocking mechanism;

DESCRIPTION OF PREFERRED EMBODIMENTS

Figure 3:
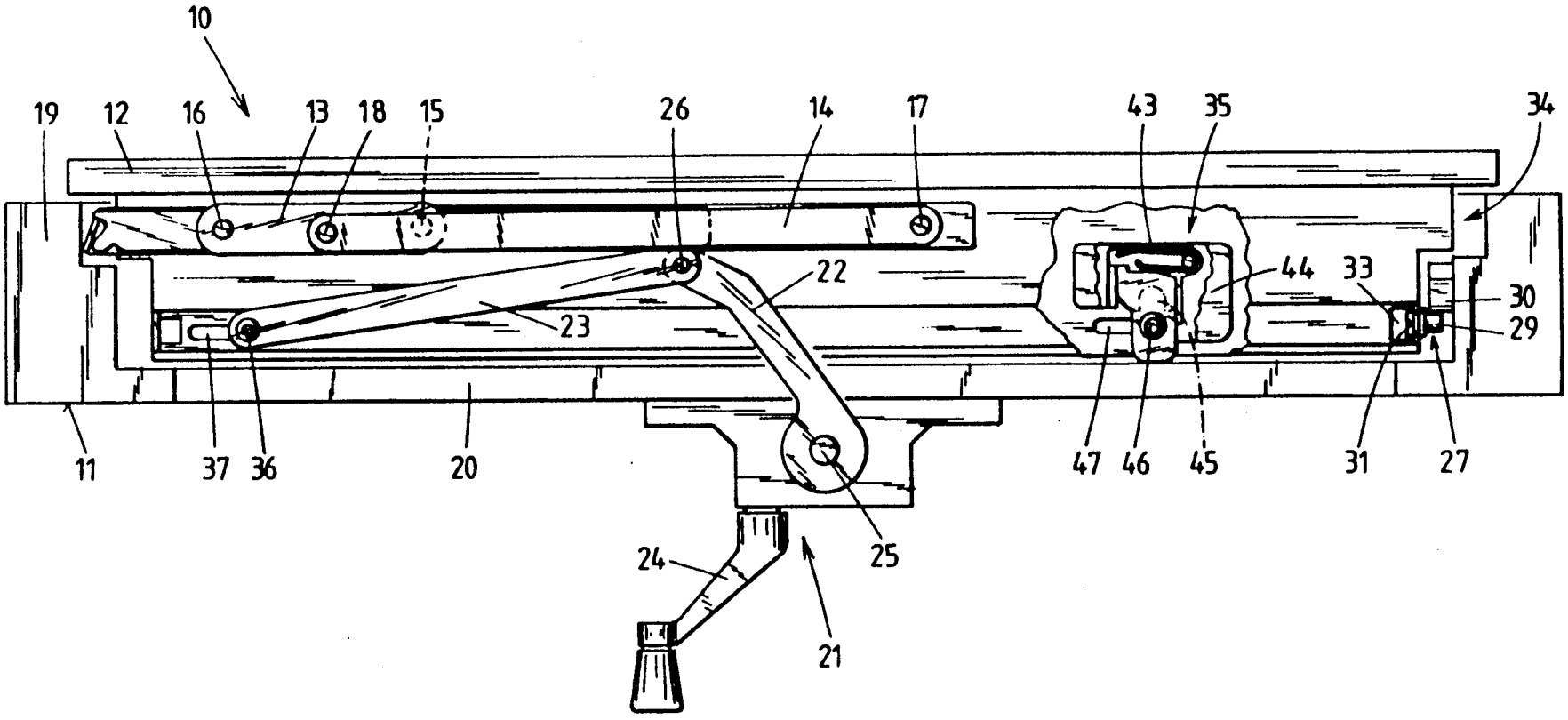
FIG. 3 illustrates the structure of FIG. 2 but with the locking-unlocking mechanism of the arresting device in the inoperative position.
Figure 4:
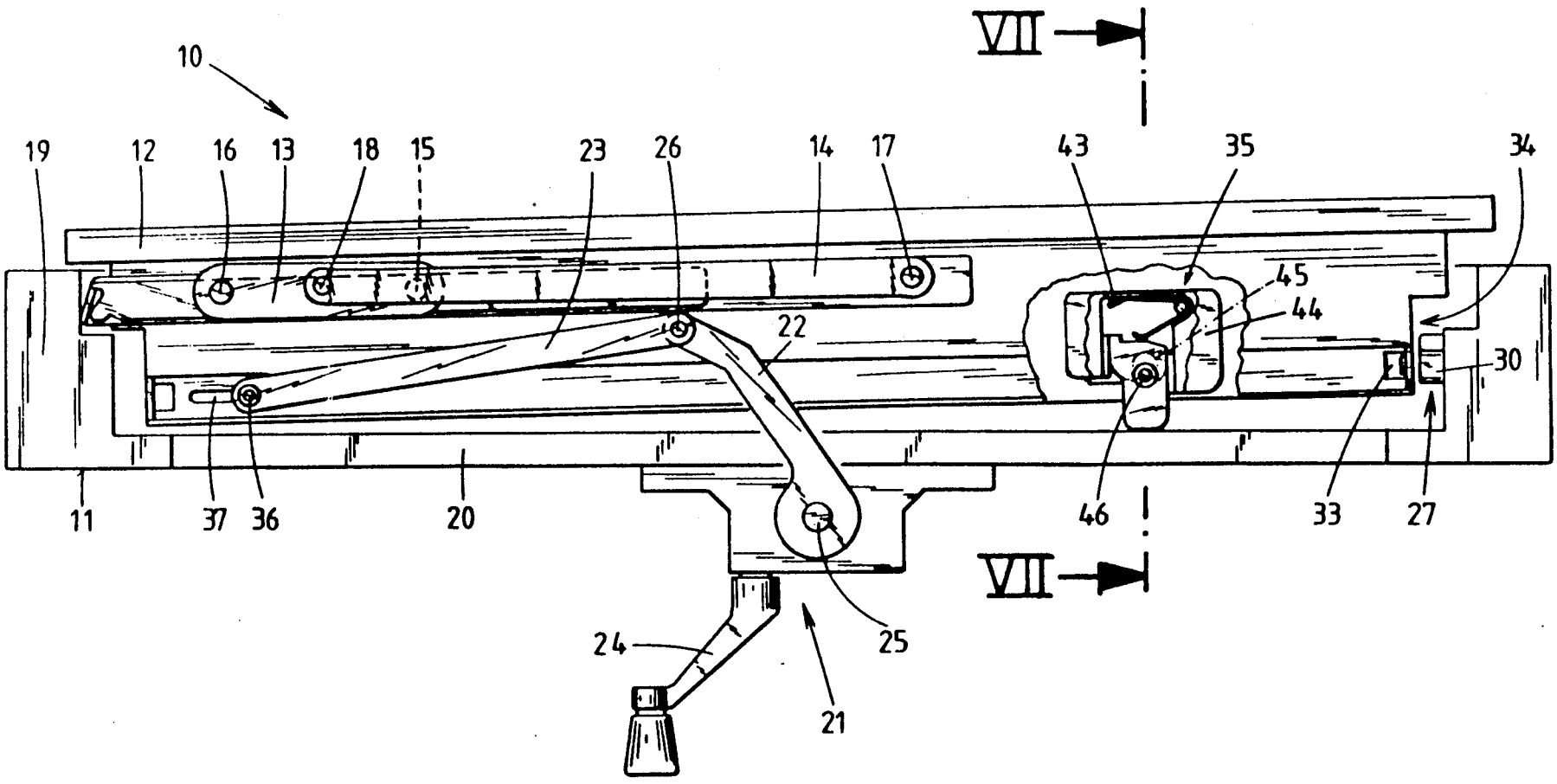
FIG. 4 shows the structure of FIG. 3 but with the sash in a partly open position in which the blocking device maintains the actuator of the locking-unlocking mechanism in the inoperative position.
Figure 5:
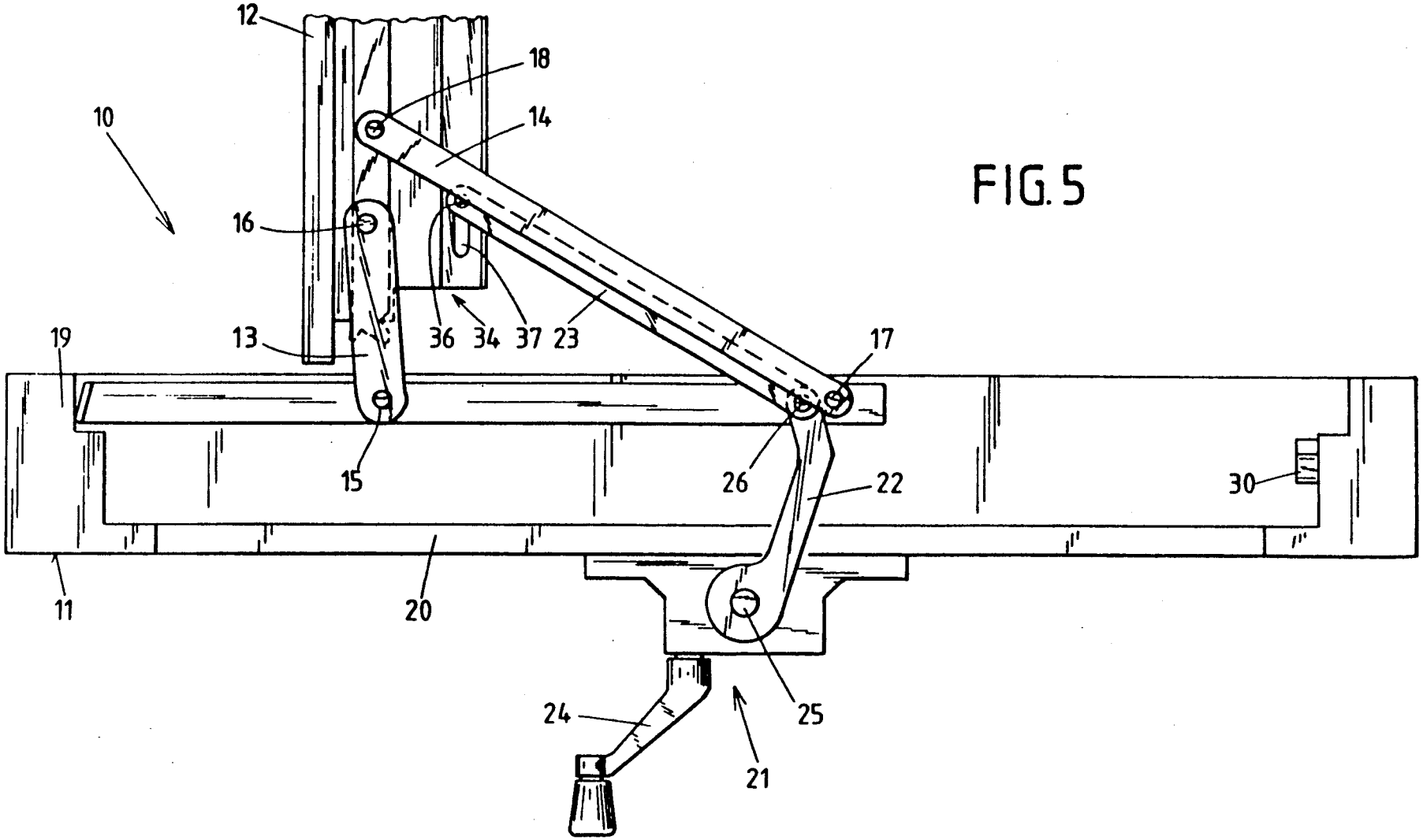
FIG. 5 is a view similar to those of FIGS. 2 to 4 but showing rhe sash in open position and partly broken away.

Referring first to FIGS. 1 to 5, there is shown a casement window 10 with a rectangular or square frame 11 and a sash 12 which is movable relative to the frame 11 between a closed position (shown in FIGS. 2 and 3) and an open position (shown in FIG. 5). To this end, and if the frame 11 is mounted in a vertical plane in an upright wall or the like, the sash 12 is preferably pivotable about a vertical axis which may but need not be closely or immediately adjacent one jamb 19 of the frame 11. The arrangement is preferably such that, when pivoted to the one position of FIG. 5, the sash 12 extends beyond the outer side of the frame 11.

The means for movably securing the sash 12 to the frame 11 comprises two pairs of links each of which includes a shorter link 13 and a longer link 14. FIGS. 2 to 5 show only one pair of links, namely those links which are adjacent the horizontal bottom frame member 20 of the frame 11. A first pivot pin 15 is provided to articulately connect one end of the link 13 to the frame 11, and a second pivot pin 16 is used to articulately connect the other end of the link 13 to the sash 12. The link 14 is considerably longer than the link 13 and one of its ends is articulately connected to the frame 11 by a first pivot pin 17. A second pivot pin 18 is provided to articulately connect the other end of the link 14 to the sash 12. The mounting of the other pair of links between the top portion of the sash 12 and the upper horizontal frame member of the frame 11 is preferably identical to the mounting of the just described links 13 and 14. The two pairs of links 13, 14 ensure that, during movement from the closed position of FIG. 2 to the open position of FIG. 5, the sash 12 moves along a complex path which leads to an open position (FIG. 5) in which the sash is somewhat spaced apart from the adjacent jamb 19 of the frame 11.

The means for moving the sash 12 between the open and closed positions comprises a crank drive 21 which is mounted at the inner side of the window 10 substantially or exactly midway between the jambs 19 of the frame 11 and on the lower horizontal frame member 20. The moving means further comprises a lever 22 which is pivotable by the crank drive 21 in a clockwise as well as in a counterclockwise direction. The crank drive 21 comprises a standard step-down transmission (not specifically shown) and a crank arm or handle 24 which can be manipulated by hand to turn a shaft 25 for the lever 22 clockwise or counterclockwise, depending upon the desired direction of pivotal movement of the sash 12. The lever 22 serves to pivot the sash 12 (and hence the links 13, 14) through the medium of a coupling unit which includes an elongated link-shaped motion transmitting member 23 and two pivot pins 26, 36. The aforementioned step-down transmission in the casing of the crank drive 21 can comprise a worm which is rotatable by the handle 24 and a worm wheel which meshes with the worm and is connected with the shaft 25 for the lever 22. The worm and worm wheel constitute a self-locking step-down transmission which ensures that the angular position of the sash 12 can be changed only in response to manipulation of the handle 24 of the crank drive 21. This guarantees that even a strong wind cannot change the angular position of the sash 12 when the latter is held in the fully open or in a partly open position.

Figure 1:
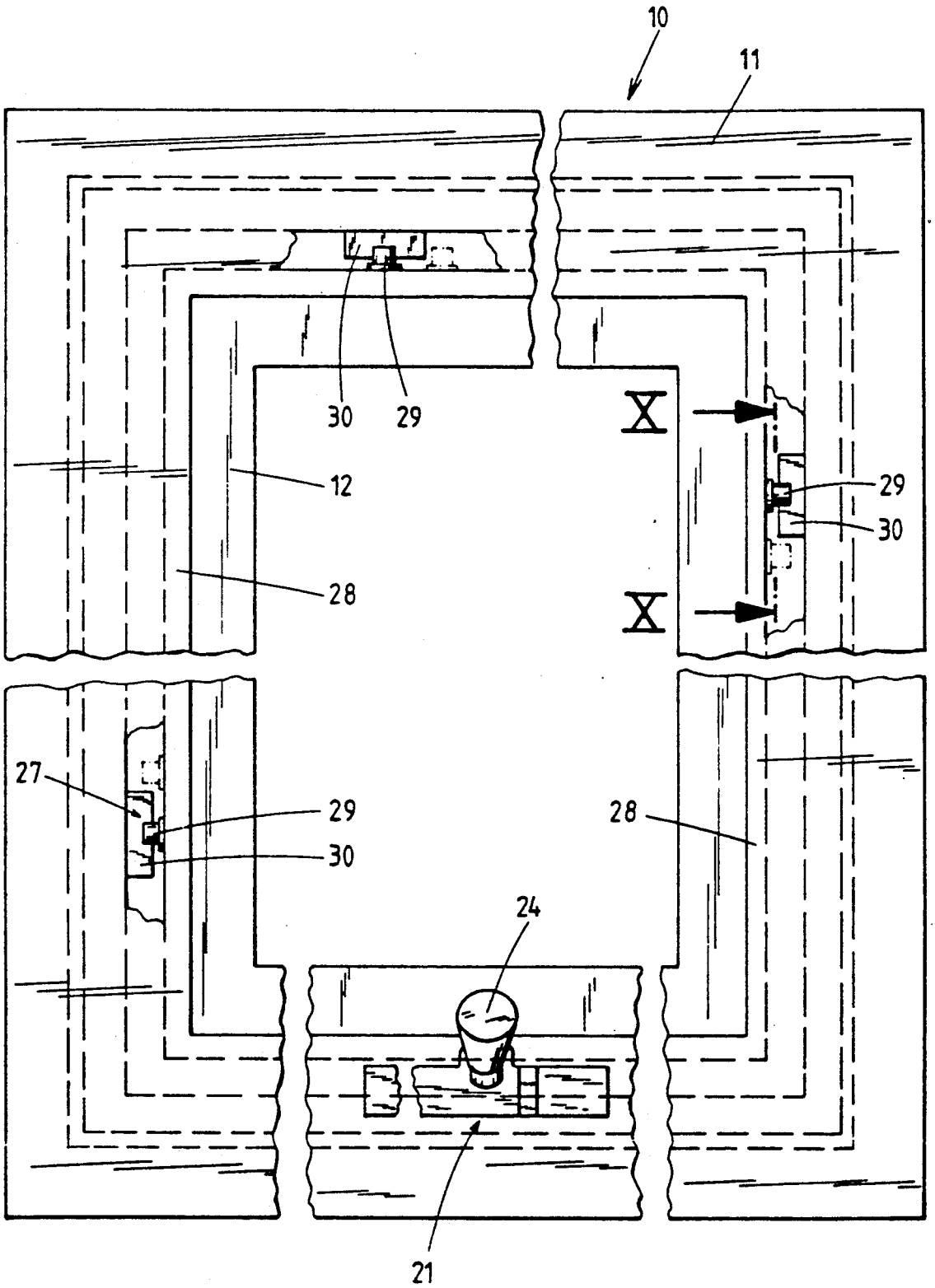
FIG. 1 is a schematic front elevational view of the inner side of a casement window which embodies one form of the invention, the sash being shown in closed position and certain parts of the window frame and of the sash being broken away.

The pivot pin 26 articulately connects one end of the motion transmitting member 23 (hereinafter called link for short) with the free end of the lever 22, and the pivot pin 36 articulately connects the other end of the link 23 with the sash 12 by way of an actuator 31 forming part of an arresting device 27 having or constituting a mechanism for locking and unlocking the sash 12 when the latter assumes the closed position of FIG. 2. The locking-unlocking mechanism of the arresting device 27 further comprises a plurality of first detents 30 which are provided on the frame 11 around the opening for the sash 12 (FIG. 1 shows three detents 30 each adjacent a different side of the opening for the sash), and second detents 29 which are provided on the sash and each of which can engage the adjacent detent 30 in response to movement of the actuator 31 from an inoperative position to an operative position. Such movement of the actuator 31 to the operative position can take place only when the sash 12 assumes the closed position of FIG. 2, and the movement of the actuator 31 from its operative position must precede the movement of the sash 12 from the closed position of FIG. 2. The purpose of the arresting device 27 is to secure the sash 12 in the closed position as well as to press the frame of the sash against the adjacent members of the frame 11 to thus ensure the establishment of a weatherproof connection between 11 and 12. The customary weatherstripping (such as that known as dual leaf and bulb weatherstripping) between the sash 12 and the frame 11 is not shown because its design forms no part of the present invention.

Figure 7:
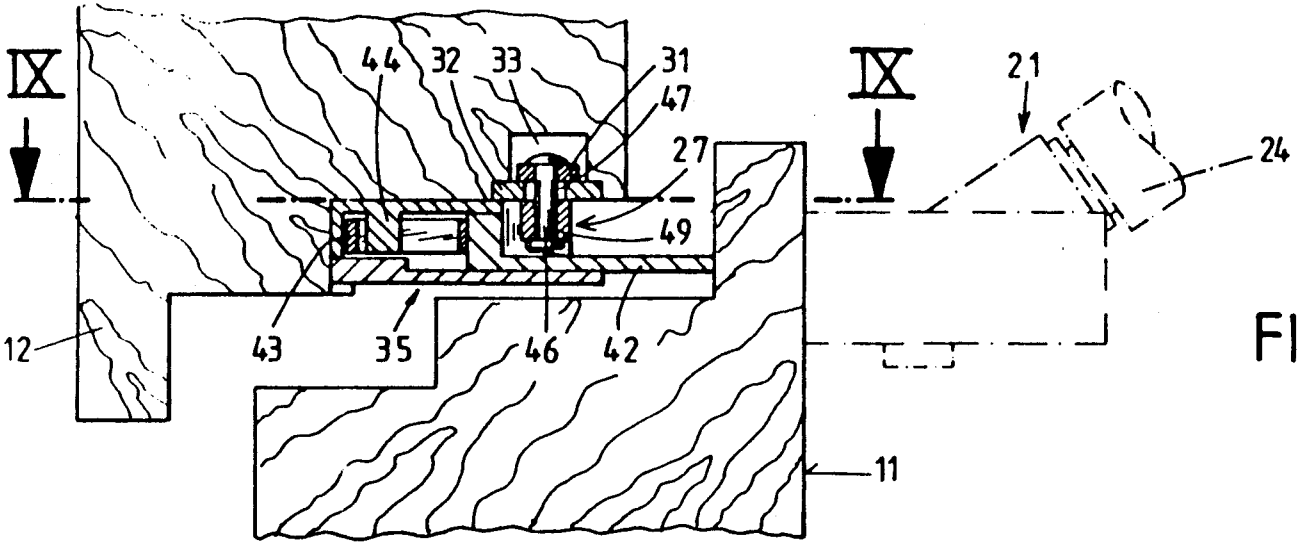
FIG. 7 is a vertical sectional view substantially as seen in the direction of arrows from the line VII—VII in FIG. 4 and shows the blocking element of the blocking device in the blocking position to hold the actuator of the locking-unlocking mechanism in the inoperative position.

The actuator 31 is movably installed in a circumferentially extending groove 32 which is provided in a border 34 of the sash 12 and is overlapped by a cover 32 (FIGS. 6, 7) affixed to (and hence considered to form part of) the sash 12. It is particularly desirable to provide one or more pairs of cooperating first and second detent members 30, 29 at both jambs 28 of the sash 12 so that such jambs can be held in optimum positions relative to the respective jambs 19 of the frame 11 when the sash 12 is maintained in the closed position of FIG. 2. The actuator 31 has limited freedom of movement relative to the sash 12; to this end, the pin 36 for the link 23 extends through an elongated slot 37 in the cover 32 to connect the link 23 with the actuator 31. The legth of the slot 37 determines the extent of movability of the actuator 31 between its operative and inoperative positions. Such movability should suffice to enable the mobile detents 29 to engage or to become disengaged from the adjacent stationary detents 30 in the closed position of the sash 12. The corner portions of the border 34 of the sash 12 are provided with arcuate deflectors (not specifically shown) for the respective portions of the actuator 31.

This renders it possible to employ a one-piece actuator 31 which surrounds at least the major part of the border 34. Actuators of the type capable of being used in the window 10 of the present invention are known from the art of conventional windows which are equipped with pivotable sashes.

The actuator 31 receives motion from the crank drive 21 by way of the lever 22, pin 26, link 23 and pin 36. The arrangement is such that, when the handle 24 is rotated in a direction to pivot the sash 12 from the closed position toward or all the way to the open position, initial pivoting of the lever 22 entails a movement of the actuator 31 from the operative position to the inoperative position (i.e., the mobile detents 29 are disengaged from the stationary detents 30) before the sash actually begins to pivot away from the closed position of FIG. 2. On the other hand, when the direction of rotation of the handle 24 is reversed, because the operator wishes to return the sash 12 from the open or a partly open position to the closed position of FIG. 2, movement of the sash to the closed position is completed before the link 23 and the pin 36 cause the actuator 31 to reassume its operative position so that the mobile detents 29 engage the adjacent stationary detents 30 and lock or arrest the sash in the closed position of FIG. 2.

In accordance with a further feature of the invention, the window 10 comprises a blocking device 35 for the arresting device 27. More specifically, a reciprocable blocking element 42 (see particularly FIGS. 6 to 9) of the blocking device 35 serves to block the actuator 31 of the locking-unlocking mechanism of the arresting device 27 in the inoperative position in automatic response to pivoting of the sash 12 from the closed position. In other words, the actuator 31 is held in the inoperative position as long as the sash 12 is held in the open position as well as during a substantial portion or stage of movement of the sash from the open position of FIG. 5 back to the closed position of FIG. 2. The blocking element 42 of the blocking device 35 is held in the blocking position by biasing means 43 (see particularly FIGS. 6 to 9) as long as the sash 12 is held out of the closed position, and a tongue- or prong-like protuberance 59 of the element 42 is displaced by the sash 11 when the sash is already close to and continues to move toward the closed position so that the biasing means 43 is caused to store energy and the element 42 then releases the actuator 31 for movement to the operative position in response to further rotation of the handle 24 in a direction to move the sash to the closed position. This ensures that, when the rotation of the handle 24 (subsequent to actual closing of the sash 12) is terminated, the mobile detents 29 engage the adjacent stationary detents 30 and lock the sash in the closed position.

FIG. 3 shows the lever 22 in an intermediate position in which the lever has caused the link 23 to shift the pin 36 from the left-hand end to the right-hand end of the slot 37 in the cover 32 so that the actuator 31 has been caused to disengage the movable detents 29 from the adjacent stationary detents 30 and the sash 12 is unlocked and is free to begin its pivotal movement toward the position of FIG. 5 in response to further rotation of the handle 24 in a direction to turn the lever 22 clockwise (as seen in FIG. 3). Since the sash 12 is still maintained in the closed position, the frame 11 maintains the blocking element 42 away from the blocking position, i.e., the element 42 cannot interfere with movement of the actuator 31 relative to the sash and the actuator already assumes the inoperative position.

If the operator continues to turn the handle 24 so that the lever 22 is pivoted from the position of FIG. 3 to the position of FIG. 4, the link 23 cooperates with the pin 36 of the actuator 31 to pivot the sash 12 from the closed position whereby the blocking element 42 moves with as well as relative to the pivoting sash and moves its socket 45 downwardly (as seen in FIG. 4) to receive a pin 46 of the actuator 31 (which has already assumed its inoperative position). Thus, the actuator 31 is then blocked in the inoperative position as long as the sash 12 is held out of the closed position. Pivotal movements of the sash 12 from the closed position of FIG. 3 through the partly open position of FIG. 4 and to the open or nearly fully open position of FIG. 5 are controlled by the two pairs of links 13, 14 which can be said to constitute a hinge defining a vertical pivot axis which is nearer to one vertical jamb 19 than to the other vertical jamb of the frame 11.

FIG. 4 shows that a relatively small angular movement of the sash 12 from the fully closed position (e.g., through an angle of 1°) suffices to enable the blocking element 42 to engage the pin 46 of the actuator 31 and to thus maintain the actuator in the inoperative position. The socket 45 of the blocking element 42 is automatically moved to a position (shown in FIG. 2) in which such socket is located adjacent the path of movement of the actuator 31 and its pin 36 between operative and inoperative positions when the sash 12 reassumes its closed position because the frame 11 then maintains the protuberance 59 of the element 42 in the depressed position of FIG. 2.

FIG. 10 shows the details of one presently preferred first detent 30 on the frame 11 and of the associated second detent 29 on the sash 12. The detent 29 includes a cylindrical stud-shaped follower 38 which is affixed to or forms part of the actuator 31 and extends from the groove 32 of the border 34 by way of an elongated slot 39 in the cover 32. This slot 39 (and more particularly the surface bounding the slot) also constitutes a means for limiting the extent of movability of the actuator 31 relative to the sash 12, i.e., for confining the actuator to movements between its operative and inoperative positions. The stationary detent 30 which is shown in FIG. 10 includes a block-shaped cam 41 with cam faces 40 which guide the follower 38 of the adjacent detent 29 to and from the position of overlap with a platform of the cam 41. When in the solid-line position of FIG. 10, the follower 38 engages the platform of the cam 41 and the detents 29, 30 then maintain the adjacent jamb 28 of the sash 12 in an optimum (closed) position relative to the respective jamb 19 of the frame 11 because the actuator 31 is then held in the operative position. The follower 38 can bypass the cam 41 when it assumes the phantom-line position of FIG. 10; at such time, the actuator 31 is maintained in the inoperative position. The follower 38 (here shown as a stud having a cylindrical peripheral surface and being riveted, welded or otherwise affixed to the actuator 31) assumes the broken-line position of FIG. 10 when it tracks one of the two mirror symmetrical cam faces 40 on the cam 41.

FIG. 11 shows mobile and stationary detents 29' and 30' forming part of the locking-unlocking mechanism of a modified locking or arresting device 27'. The detent 30' comprises a block-shaped cam 41' which is riveted or otherwise affixed to the frame 11, and the detent 29' comprises a non-cylindrical stud-shaped follower 38' having two facets 52, 54 and a platform 50 opposite a platform 53. The platform 50 and the facet 52 together constitute a two-part cam face. The facet 54 slides along one of the cam faces 40' of the cam 41' during movement of the actuator 31 and its follower 38' toward the operative position which is shown in FIG. 11 by solid lines. When the follower 38' assumes the phantom-line position of FIG. 11, the actuator 31 is held in the inoperative position and the detent 29' can bypass the detent 30' to permit a movement of the sash 12 from the closed position. The broken-line position of the follower 38' is an intermediate position, i.e., the actuator 31 is on its way from the operative position to the inoperative position or the other way around.

The structure which is shown in FIG. 11 further comprises means for indicating the operative or inoperative position of the actuator 31 and of its detent 29'. The illustrated indicating means is designed to indicate the operative position of the actuator 31 and comprises a reciprocable pin-shaped component 51 which is biased by a coil spring 56 away from the predetermined position which is shown in FIG. 11 and corresponds to the operative position of the actuator 31 and its detent 29'. The pin-shaped component 51 is reciprocable in a casing 55 which is installed in the frame 11, and its left-hand portion can track the facet 52 to ultimately abut the platform 50 of the adjacent detent 29' when the actuator 31 reaches the operative position, i.e., when the detent 29' has been caused to move its follower 38' from the phantom-line position, through the broken-line position and to the solid-line position of FIG. 11. The right-hand end portion of the component 51 then extends from the casing 55 and is visible at the exterior of the frame 11 to thus indicate that the actuator 31 has been moved to the operative position. Of course, concealment of the right-hand portion of the component 51 in the casing 55 indicates that the actuator 31 is maintained in the operative position (corresponding to the phantom-line position of the follower 38'). If desired, the frame 11 can carry two or more indicating means, e.g., one for each pair of cooperating detents 29', 30'.

The second platform 53 of the follower 38' abuts the cam 41' between the cam faces 40' when the actuator 31 is held in the operative position. The facet 54 slides along one of the cam faces 40' during movement of the actuator 31 and its detent 29' between the operative and inoperative positions.

Figure 2:
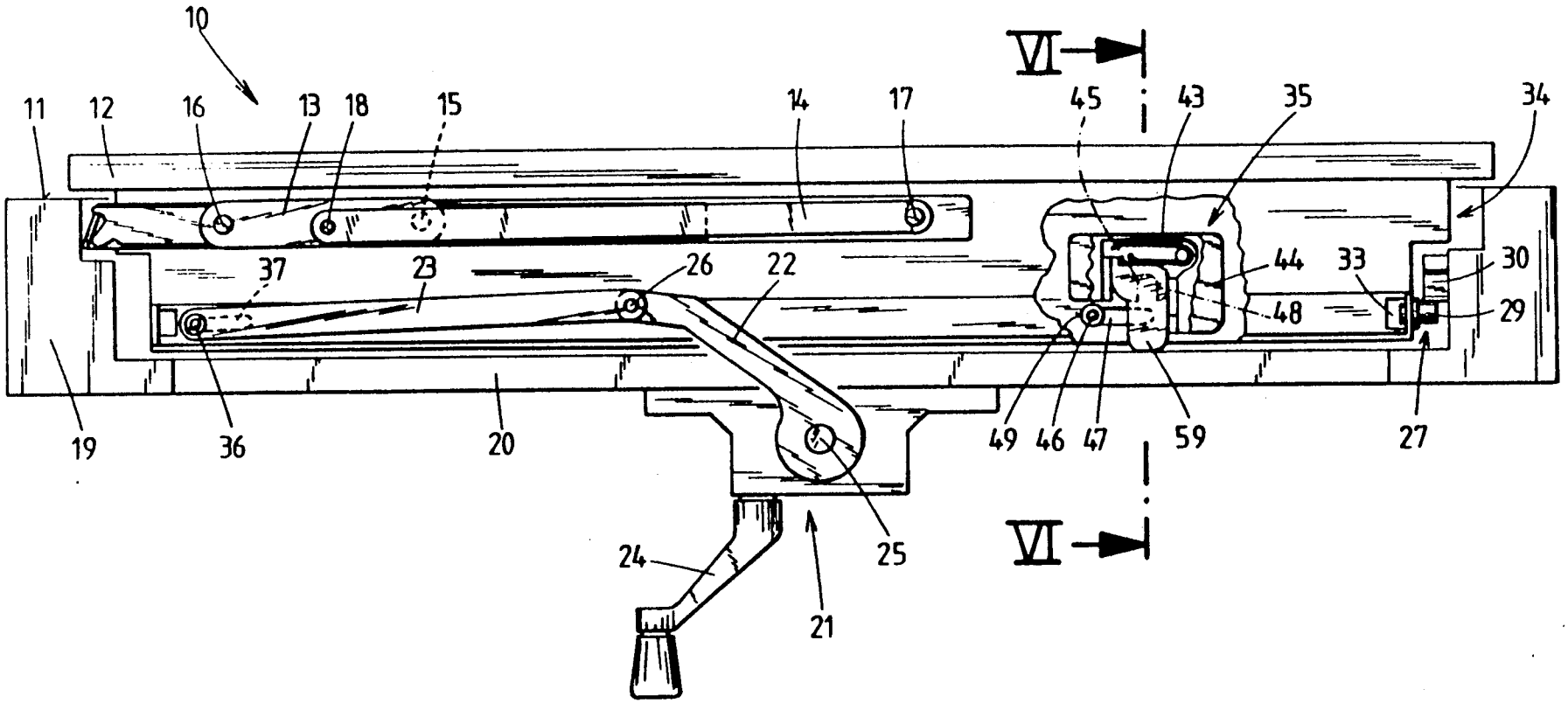
FIG. 2 is a bottom plan view of the window, with the sash in closed position and the locking-unlocking mechanism of the arresting device shown in the operative position.

The right-hand end portion of the component 51 of the indicating means of FIG. 11 can serve as a trip for a switch (not shown) which initiates the generation of optical, acoustic and/or other visible signals denoting that the actuator 31 has assumed one of its two end positions, normally the operative position in which the sash 12 is locked in the closed position of FIG. 2.

Figure 6:
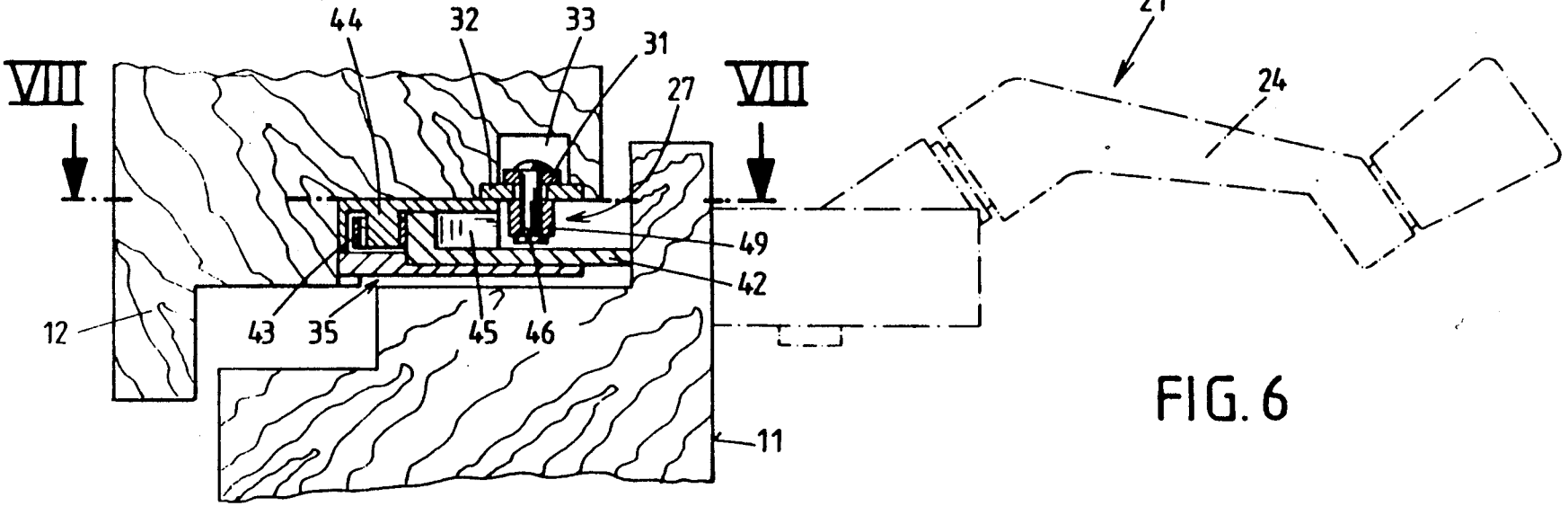
FIG. 6 is a vertical sectional view substantially as seen in the direction of arrows from the line VI—VI in FIG. 2 and shows certain details of a blocking device having a reciprocable blocking element which is shown in the idle or unlocking position.

The blocking device 35 of the window 10 which is shown in FIGS. 1 to 9 (this blocking device is best shown in FIGS. 6 to 9) comprises the aforementioned reciprocable blocking element 42 which is installed in a housing 44 of the sash 12 and is biased toward the blocking position of FIG. 9 by the adjacent leg of the torsion spring (biasing means) 43 on a fulcrum 57 of the housing 44. The unblocking or idle position of the element 42 is shown in FIGS. 6 and 8; at such time, the spring 43 maintains the protuberance 59 in abutment with the frame 11 because the sash 12 is held in the closed position. Therefore, the open slot 48 of the socket 45 in the blocking element 42 is adjacent the path of movement of the actuator 31 and its pin 46 between the operative and inoperative positions. The housing 44 confines the blocking element 42 to movements between an extended position and a depressed position.

The cover 32 of the sash 12 has an elongated slot 47 for the pin 46, and this slot also serves as a means for confining the actuator 31 to movements between its operative and inoperative positions. The open end of the slot 48 of the socket 45 is in register with the pin 46 when the actuator 31 is moved to the inoperative position of FIG. 7 or 9 so that the spring 43 can propel the element 42 to the blocking position as soon as the sash 12 is moved from the closed position of FIG. 9 so that the protuberance 59 can move with as well as relative to the sash 12 and the slot 48 moves downwardly, as seen in FIG. 8, to receive the pin 46 in the inoperative position of the actuator 31.

The housing 44 for the blocking element 42 and spring 43 is installed in the border 34 of the sash 12.

It suffices to move the sash 12 through a very small angle (e.g., an angle in the range of one degree) in order to enable the spring 43 to displace the blocking element 42 to an extent which is necessary to confine the pin 46 in the slot 48 so that the actuator 31 is blocked in the inoperative position.

The pin 46 preferably carries a rotary sleeve 49 (e.g., an annular antifriction bearing) to reduce friction between the pin 46 and the blocking element 42 during movement of the slot 48 relative to the actuator 31. A so-called deep groove ball bearing can be used with particular advantage as a sleeve 49 on the pin 46 of the actuator 31.

The open end of the slot 48 faces the adjacent portion of the frame 11 in the closed or nearly closed position of the sash 12.

Figure 12:
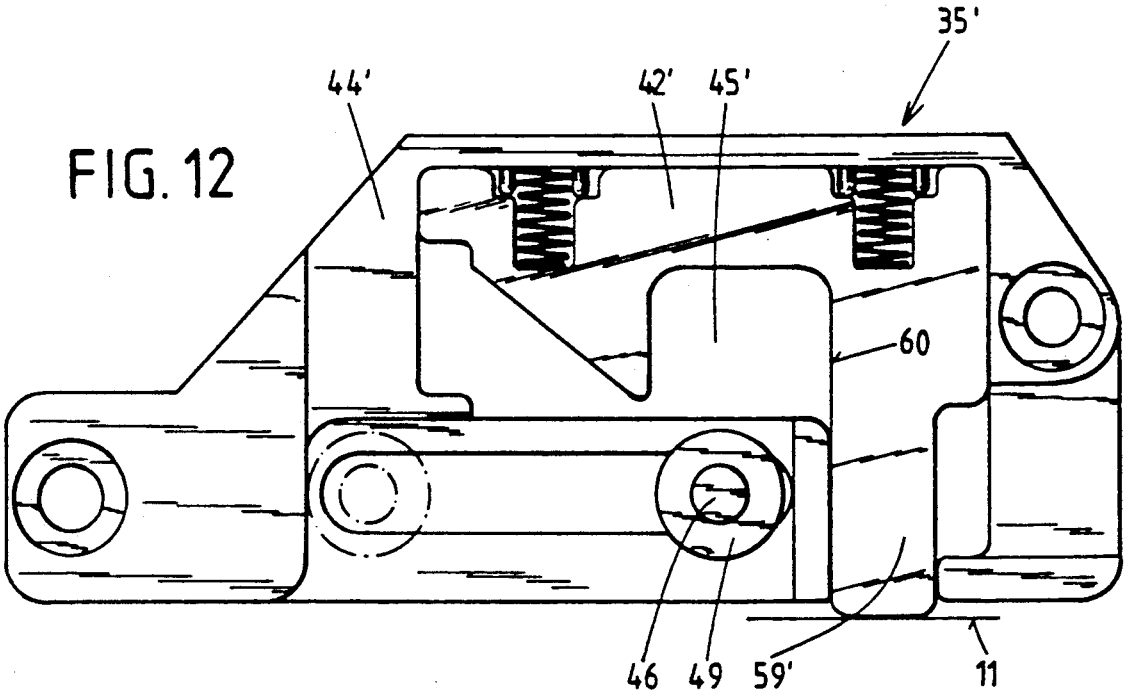
FIG. 12 is an elevational view of a second blocking device, with the blocking element shown in the idle or unblocking position in which the actuator of the locking-unlocking mechanism is free to move between the operative and inoperative positions.
Figure 13:
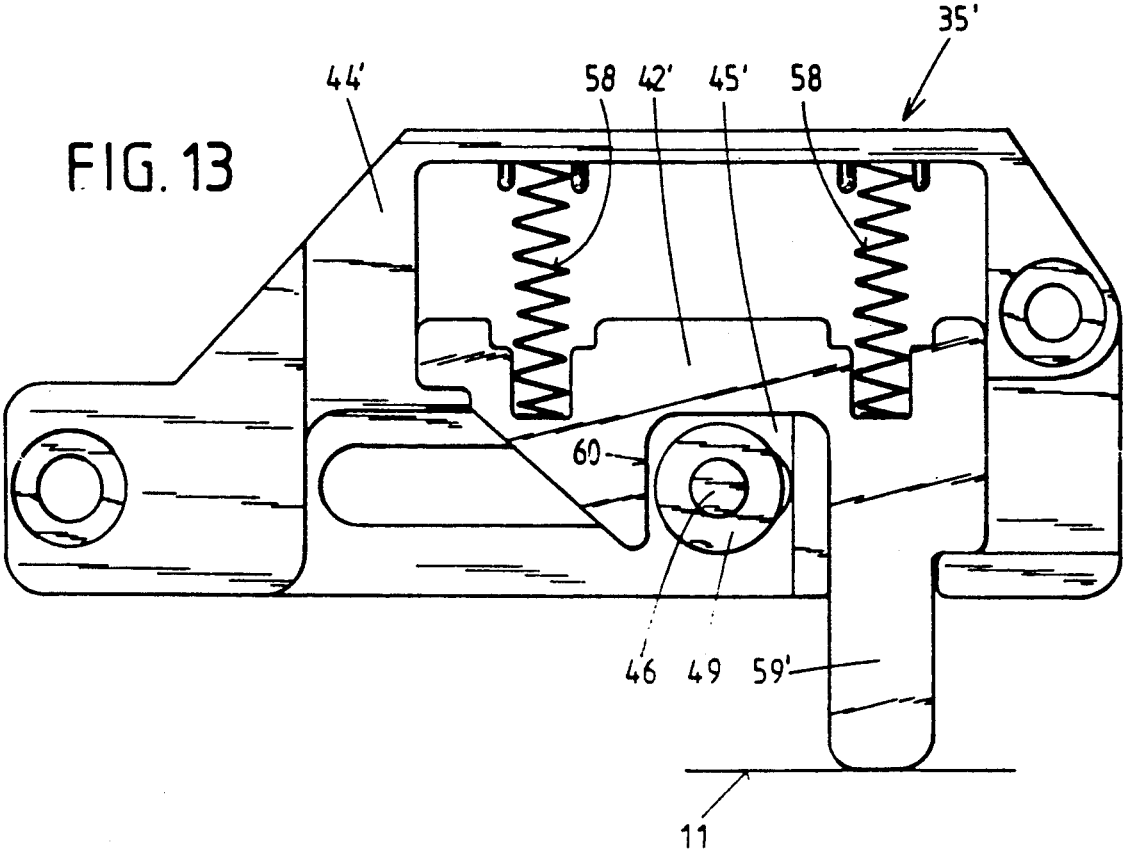
FIG. 13 is a view similar to that of FIG. 12 but showing the blocking element in the blocking position.

FIGS. 12 and 13 illustrate a modified blocking device 35' which comprises a modified blocking element 42' having a protuberance 59' in th form of a tongue or prong extending from the housing 44' which is installed in the sash 12. The socket 45' of the blocking element 42' comprises a relatively shallow recess or cutout 60 which can receive the pin 46 of the actuator 31 when the latter is held in the inoperative position (shown in FIGS. 12 and 13 by solid lines). The protuberance 59' is depressed by the frame 11 (FIG. 12) when the sash 12 is held in the closed position so that the socket 45' is out of the way and the actuator 31 and its pin 46 with sleeve 49 can move relative to the blocking element 42'. That position of the pin 46 which corresponds to operative position of the actuator 31 is indicated in FIG. 12 by phantom lines.

The blocking element 42' is permanently biased to the blocking position of FIG. 13 by two coil springs 58 whcih react against the housing 44' and bear against the blocking element. The axes of the coil springs 58 are or can be at least substantially parallel to the direction of reciprocatory movement of the blocking element 42' between teh blocking position of FIG. 13 and the unblocking or idle position of FIG. 12. The element 42' can be biased by a single coil spring 58 or by three or more coil springs. Furthermore, the illustrated coil springs 58 can be replaced by or used jointly with other types of springs without department from the spirit of the invention.

The housing for the mobile blocking element is preferably remote from the links 13, 14 (see FIG. 2).

Referring to FIGS. 14 to 17, there is shown a blocking device 35" which is mounted on the sash 12 and has a composite blocking element 42" including two pawls 62, 63 which jointly perform the function of the blocking element 42 or 42'. The first pawl 62 is pivotable about the axis of a pivot member 65 which is mounted in the housing 44" of the blocking device 35" and has a socket 61 in the form of an open-ended slot serving to receive the pin 46 of the actuator 31. The pawl 62 has a pin-shaped retainer 70 for one end convolution of a biasing means in the form of a coil spring 72 which tends to turn the pawl 62 in a counterclockwise direction (as viewed in FIGS. 14–17) and to thereby maintain an edge face or abutment 68 of the pawl 62 in engagement with a slot face 69 of the housing 44". The pawl 62 then assumes a first position in which its socket or slot 61 is properly positioned to receive the pin 46 of the actuator 31 when the pin 46 is moved in a direction to the right.

Figure 14:
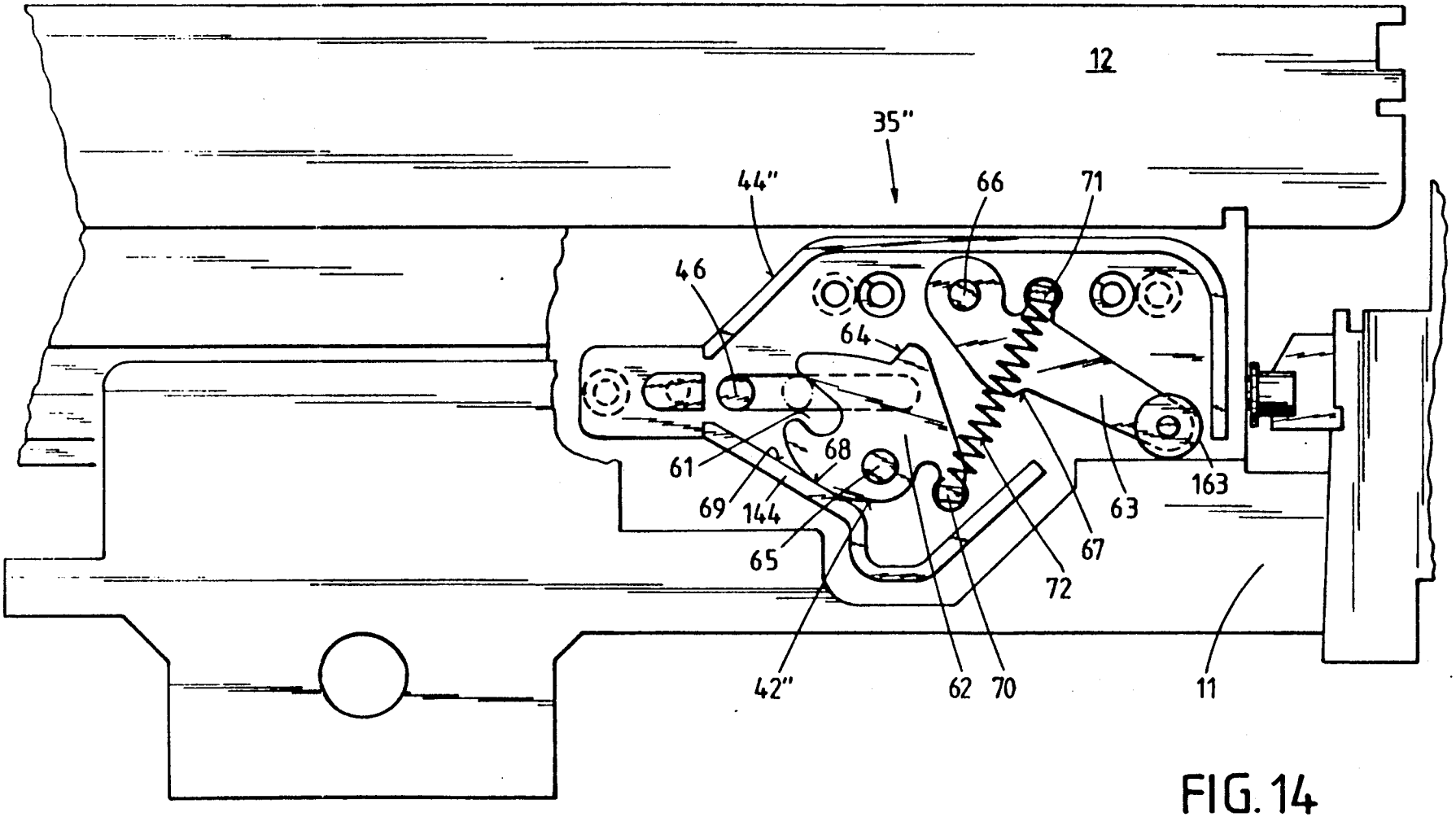
FIG. 14 is an elevational view of a third blocking device wherein a composite blocking element comprises two pivotable pawls, the blocking element being shown in a position ready to be moved to blocking position by a portion of the actuator of the locking-unlocking mechanism for the sash.
Figure 15:
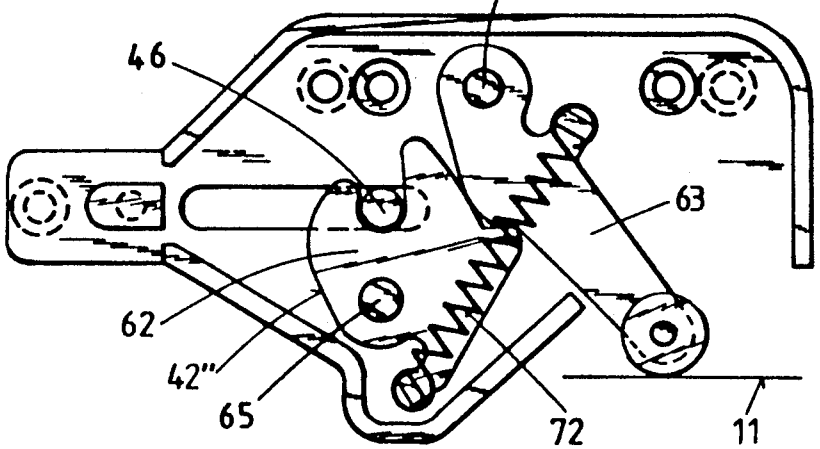
FIG. 15 shows certain details of the blocking device of FIG. 14, with the composite blocking element in the blocking positions.

The second pawl 63 of the composite blocking element 42" is pivotable with or on a pivot member 66 which is mounted in the housing 44". The pawl 63 includes a roller follower 163 which can be engaged by the frame 11 in order to pivot the pawl 63 in a counterclockwise direction from a first position which is shown in FIG. 15 to a second position which is shown in FIG. 14. A retainer 71 of the pawl 63 is connected with the other end convolution of the coil spring 72 which tends to turn the pawl 63 in a clockwise direction (to the first position of this pawl). The pawls 62, 63 have cooperating projecting portions 64, 67 which are in engagement (FIG. 15) to maintain the pawl 62 in a second position which is shown in FIG. 15 (provided that the sash 12 is not in the closed position), and the pawl 63 releases the pawl 62 for pivotal movement in a clockwise direction (under the action of the pin 46 which enters the socket 61 in response to movement in a direction to the right) when the follower 163 is caused to pivot the pawl 63 because it is engaged by the frame 11. The pawl 62 is then biased by the spring 72 which causes it to move to the position of FIG. 14 in which the pin 46 is free to enter or leave the socket 61 because the abutment 68 engages the stop face 69 of the housing 44".

The projecting portions 64, 67 are simple protrusions in the form of teeth or pallets which are engaged by each other and hold the pawl 62 in the (second) angular position of FIG. 15 in which the actuator 31 and its pin 46 are prevented from leaving their inoperative positions. The spring 72 tends to pivot the pawl 62 in a counterclockwise direction; however, this pawl is also pivotable (clockwise and counterclockwise) by the pin 46 of the actuator 31. The latter is movable by the crank drive 21 of the means for moving the sash 12 between its open and closed positions by way of the lever 22, link 23 and coupling pins 26, 36. In other words, the pawl 62 of the blocking device 35" is pivotable back and forth by the crank drive 21. Of course, the pawl 62 can be pivoted by the crank drive 21 (through the medium of the actuator 31) only when its projecting portion 64 is released by the projecting portion 67 of the pawl 63. Thus, the actuator 31 can be moved to the operative position (in which it prevents the sash 12 from leaving the closed position) only when the frame 11 has already pivoted the pawl 63 as a result of movement of the sash to the closed position, and more specifically during the last stage of movement of the sash to its closed position. FIG. 14 shows the sash 12 in the closed position and, therefore, the pawl 63 is disengaged from the pawl 62 which has permitted the actuator 31 and its pin 46 to assume their operative positions. At such time, the abutment 68 of the pawl 62 engages the stop face 69 of the housing 44". This ensures that the angular position of the socket or slot 61 is best suited for reception of the pin 46 when the crank drive 21 is operated in a direction to move the actuator 31 and the pin 46 from the operative positions of FIG. 14 to the inoperative positions of FIG. 17, i.e., to move the pin 46 from the left-hand end into the right-hand end of the slot 47 in the cover 32. Such movement of the pin 46 entails a pivotal movement of the pawl 62 in a clockwise direction from the position of FIG. 14, through the positions of FIGS. 15 and 16 and on to the position of FIG. 17 in which the sash 12 is held in an at least partially open position and, therefore, the portion 67 of the pawl 63 engages the portion 64 of the pawl 62 to hold the actuator 31 and its pin 46 in the inoperative positions.

As mentioned above, the coil spring 72 permanently biases the pawl 63 toward its first position (of engagement of its portion 67 with the portion 64 of the pawl 62), and the spring 72 further tends to maintain the pawl 62 in the position of FIG. 14 in which the socket 61 is ready to receive the pin 46 and the latter can pivot the pawl 62 clockwise in response to movement of the actuator 31 to its inoperative position (FIG. 17) in which the actuator 31 is maintained because the sash 12 is out of the closed position. The spring 72 is caused to store energy while the pawl 62 is pivoted clockwise from the position of FIG. 14 to the position of FIG. 17. The spring 72 also stores energy during pivoting of the pawl 63 by the frame 11, i.e., during the last stage of movement of the sash 12 to its closed position.

FIG. 15 shows the pawl 62 in a position in which the pin 46 of the actuator 31 has assumed a position close to the inoperative position, i.e., the detents 29 are disengaged from the detents 30 and the detents 29 cannot be moved into engagement with the detents 30. The projecting portion 67 of the pawl 63 engages the projecting portion 64 of the pawl 62 and, therefore, the pawl 63 prevents the pawl 62 from pivoting under the bias of the spring 72, namely in a direction to move its abutment 68 back into engagement with the stop face 69 of the housing 44". The follower 163 of the pawl 63 is not engaged by the frame 11.

Figure 16:
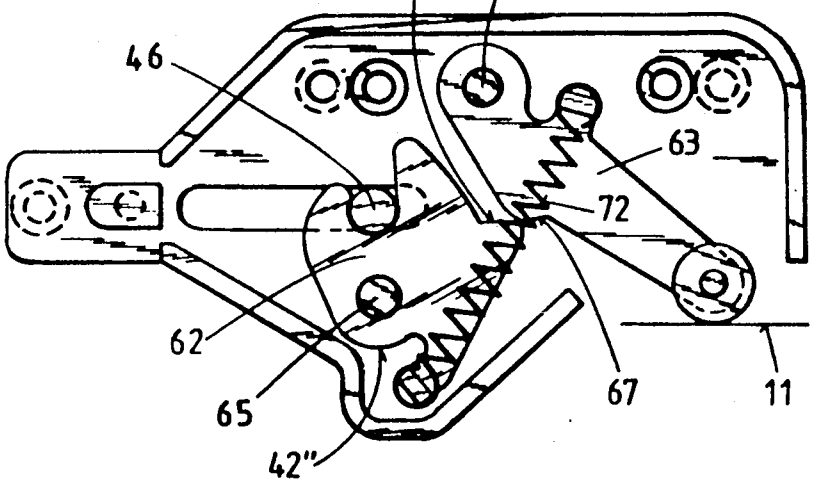
FIG. 16 illustrates the structure of FIG. 15 but with the composite blocking element in a different position.
Figure 17:
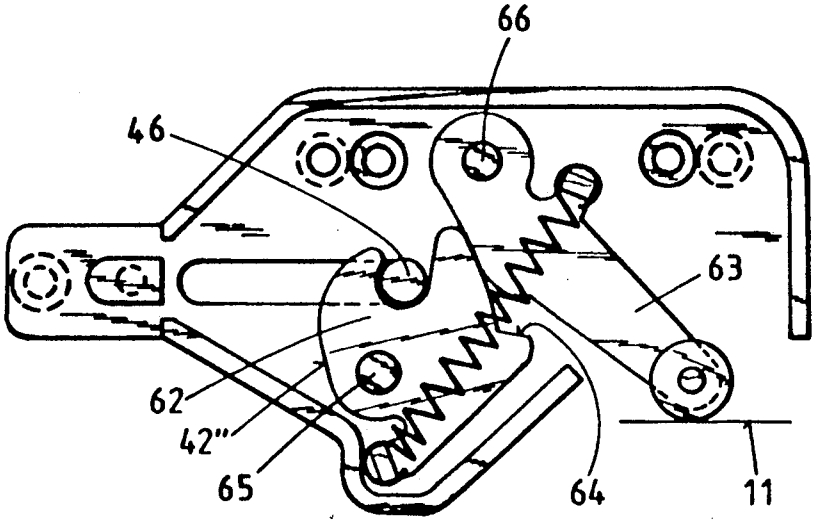
FIG. 17 is a view similar to that of FIG. 15 or 16 but showing the composite blocking element in a position in which the actuator of the locking-unlocking mechanism is free to move between its operative and inoperative positions.

In FIG. 16, the follower 163 is engaged by the frame 11 and the frame has changed the angular position of the pawl 63 so that the projecting portion 67 can be bypassed by the projecting portion 64 of the pawl 62. Therefore, the crank drive 21 is free to move the actuator 31 and its pin 46 back toward the positions of FIG. 14. It is to be noted however, that the position of the pin 46 in FIG. 16 corresponds or is close to the inoperative position of the actuator 31, i.e., the crank drive 21 is yet to be operated in a sense to cause a movement of the pin 46 in a direction to the left, namely from the position of FIG. 16 to the position of FIG. 14.

Figures 18, 19:
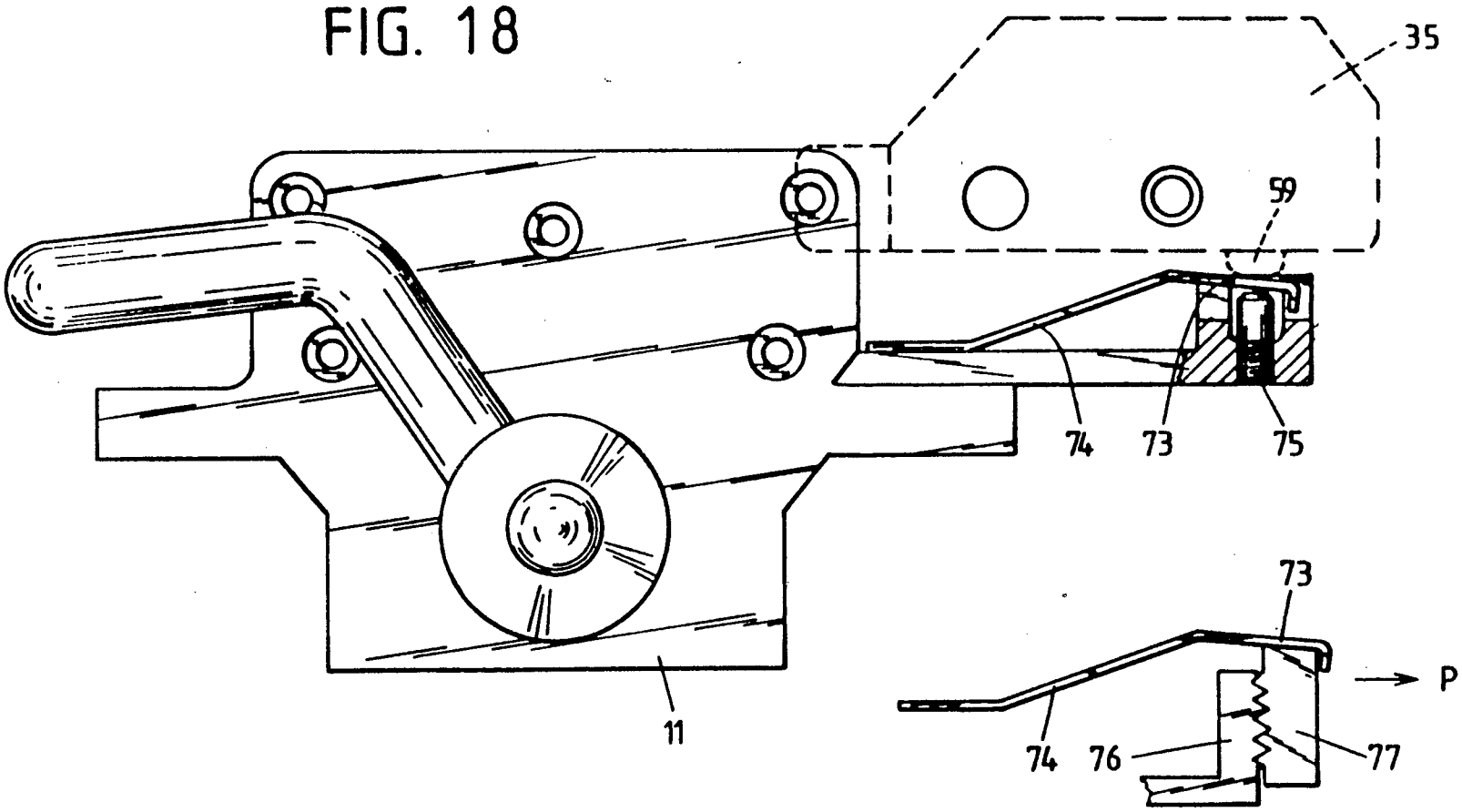
FIG. 18 illustrates a device for adjusting the position of a reciprocable blocking element of the type shown in FIGS. 6-9 or 12-13.
FIG. 19 illustrates a portion of a modified adjusting device.

The improved window 10 can be provided with means for adjusting the extended position of the blocking element 42, 42' or 42". The manner in which the extended position of the blocking element 42 or 42' can be adjusted is shown in FIG. 18. Thus, the protuberance 59 (or a portion of this protuberance) abuts an adjustable stop 73 in the form of a plate which forms part of a metallic or plastic strip-shaped carrier 74 affixed to the frame 11 in the path of movement of the protuberance 59 under the bias of the torsion spring 43 or coil springs 58 (not shown in FIG. 18). The position of the stop 73 can be adjusted (between an infinite number of different positions) by an externally threaded member here shown as a bolt 75 having a head which engages the stop 73 opposite the protuberance 59. The lower end of the bolt 75 (as viewed in FIG. 18) can be slotted or otherwise shaped to accept the working end of a screwdriver or another suitable tool which enables the person in charge to select the axial position of the bolt 75 and to thus locate the stop 73 which thereby holds the protuberance 59 (and the entire blocking element 42 or 42') in a newly selected extended position. This renders it possible to select an optimum extended position for the blocking element 42, 42', namely a position in which the blocking element reliably prevents a movement of the actuator 31 from the inoperative position when the sash 12 has been pivoted away from the closed position. The carrier 74 can be made of a suitable resilient material and can constitute a leaf spring one end of which is affixed to the frame 11 in cantilever fashion. The external thread of the bolt 75 mates with an internal thread in a tapped bore or hole of the frame 11.

FIG. 19 illustrates modified adjusting means for the adjustable stop 73 of the strip 74. The difference between the embodiments of FIGS. 18 and 19 is that the adjusting means of FIG. 19 can locate the stop 73 in a finite number of different positions. To this end, the stop 73 carries a first toothed or serrated section 77 and the frame 11 carries a second toothed or serrated section 76 which meshes with the section 77. In order to change the position of the stop 73 relative to the frame 11, the operator pulls the section 77 away from the section 76 (arrow P in FIG. 19) so that the section 77 is disengaged from the section 76 against the opposition of the springy strip-shaped carrier 74, and the level of the stop 73 is thereupon changed before the section 77 is moved back into mesh with the section 76 to locate the protuberance 59 (not shown in FIG. 19) in a newly selected extended position.

The number of teeth on the sections 76, 77 determines the number of different positions of the stop 73. One of these sections can be provided with a single tooth which can be moved into mesh with a selected pair of numerous teeth on the other section.

The pawl 62 of FIGS. 14 to 17 can be adjusted by making that portion (144) of the housing 44" which includes the stop face 69 movable to thereby select the first or starting position of the pawl 62. The portion 144 can be replaced with a strip corresponding to the strip 74 of FIG. 18 or 19, and such movable portion 144 is then adjustable by a bolt 75 or the like or by a mechanism including or equivalent to the sections 76, 77 of FIG. 19.

An important advantage of the improved window is that the manipulation of a single part (handle 24 of the crank drive 21) suffices to move the sash 12 between open and closed positions, to move the actuator 31 of the locking-unlocking mechanism of the arresting or locking device 27 between the operative and inoperative positions, and to effect the operation of the blocking device 35, 35' or 35" in order to prevent the actuator 31 from assuming the operative position except when the sash 12 is close to or actually assumes the closed position of FIG. 2. The movements of the sash 12 between its open and closed positions and the movements of the actuator 31 between its operative and inoperative positions are invariably carried out in proper sequence, i.e., a movement of the actuator 31 from the operative position precedes the movement of the sash 12 from the closed position, and a movement of the sash to the closed position precedes the movement of the actuator 31 to the operative position. In other words, the operation is foolproof, and the same applies for the operation of the blocking device 35, 35' or 35" because the movements of the blocking element 42, 42' or 42" are controlled by the frame 11 in cooperation with the sash 12 in automatic response to pivoting of the sash toward or from its closed position.

Another advantage of the improved window is that the actuator 31 can carry any desired number of mobile detents 29 or 29' in any desired distribution around the sash 12 because this actuator is mounted in the sash and can extend all the way around the border 34. This ensures that the sash 12 can be urged against the frame 11 at several spaced locations as soon as the sash 12 is closed, i.e., that the weatherstripping between the sash and the frame 11 is fully effective all the way around the border 34. The configuration of the followers 38 or 38' and of the associated cams 41 or 41' can be readily selected in such a way that the border 34 is urged against the adjacent portions of the frame 11 with an optimum force to establish a desirable sealing action as soon as the drive 21 moves the sash 12 to the closed position.

A further important advantage of the improved window is that the position of the actuator 31 can be monitored at all times. Thus, the operator knows that the actuator 31 is blocked in the inoperative position as long as the sash 12 is maintained in the open position. Once the sash 12 is returned to the closed position, the operator can readily ascertain whether the link 23 is held in the position of FIG. 2 or 3 (i.e., whether or not the actuator 31 has actually assumed the operative position in which the sash is locked to the frame 11) by looking at the position of the component 51 of the indicating means of FIG. 11 or by detecting the visible and/or audible and/or other signal which is initiated by the component 51 when the actuator 31 reaches its operative position to lock the sash 12 in the closed position.

The mounting of the housing 44, 44' or 44" of the blocking device 35, 35' or 35" in the border 34 of the sash 12 is desirable and advantageous because the entire blocking device is concealed and protected in closed position of the sash 12. Furthermore, and as already mentioned above, the housing 44, 44' or 44" is preferably remote from the pivot axis for the sash 12. This ensures that the blocking element 42, 42' or 42" rapidly performs a movement along a large arc in response to a relatively small pivotal movement of the sash 12 from or to the closed position of FIG. 2 or 3. Consequently, there is ample time to move the blocking element 42, 41' or 42" from the extended position and to release the actuator 31 for movement to the operative position during the last or very last stage of pivotal movement of the sash 12 to its closed position.

Accurate selection of the extended position of the blocking element 42, 42' or 42" is important in order to ensure that the initial engagement of the blocking element with and its displacement by the frame 11 is properly related to the angular position of the sash 12 with reference to the frame.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A window comprising a frame; a sash movable relative to said frame between open and closed positions; means for movably securing said sash to said frame; means for moving said sash relative to said frame; an arresting device having a mechanism for locking and unlocking said sash in the closed position; means for permanently coupling said arresting device with said moving means to unlock said sash prior to movement of the sash from said closed position and to lock said sash upon return movement to said closed position; and means for blocking said mechanism in response to movement of said sash from the closed position.

2. The window of claim 1, wherein said moving means includes a crank drive mounted on said frame and a lever pivotable by said crank drive, said coupling means including a motion transmitting member and means for articulately connecting said member with said lever and with said arresting device.

3. The window of claim 2, wherein said mechanism includes at least one first detent on said frame, at least one second detent movably mounted on said sash, and an actuator connected with and movable by said motion transmitting member between operative and inoperative positions to respectively engage said second detent with and disengage said second detent from said first detent in the closed position of said sash, said crank drive being operable to move said actuator to said inoperative position by way of said lever and said member prior to moving said sash from the closed position and to move said sash back to closed position prior to moving said actuator to said operative position.

4. The window of claim 3, wherein said sash comprises means for confining said actuator to movements between said operative and inoperative positions.

5. The window of claim 3, wherein said sash comprises a cover for said actuator, said connecting means including a pivot connecting said member with said actuator, said cover having a slot for said pivot and said slot confining said pivot to movements between first and second end positions corresponding to the operative and inoperative positions of said actuator.

6. The window of claim 3, wherein said sash comprises a cover for said actuator and said at least one second detent comprises a follower provided on said actuator, said cover having a slot through which said follower extends and which permits movements of said actuator and said follower relative to said cover between said operative and inoperative positions.

7. The window of claim 6, wherein said at least one first detent comprises a cam provided on said frame and having a face which is tracked by said follower during movement of said actuator between said operative and inoperative positions.

8. A window comprising a frame; a sash movable relative to said frame between open and closed positions; means for movably securing said sash to said frame; means for moving said sash relative to said frame, including a crank drive mounted on said frame and a lever pivotable by said crank drive; an arresting device having a mechanism for locking and unlocking said sash in the closed position; means for coupling said arresting device having a mechanism for locking and unlocking said sash in the closed position; means for coupling said arresting device with said moving means to unlock said sash prior to movement of the sash from said closed position and to lock said sash upon return movement to said closed position, including a motion transmitting member and means for articulately connecting said member with said lever and with said arresting device, said mechanism including at least one first detent on said frame, at least one second detent movably mounted on said sash, and an actuator connected with and movably by said motion transmitting member between operative and inoperative positions to respectively engage said second detent with and disengage said second detent from said first detent in the closed position of said sash, said crank drive being operable to move said actuator to said inoperative position by way of said lever and said member prior to moving said sash from the closed position and to move said sash back to closed position prior to moving said actuator to said operative position; means for blocking said mechanism in response to movement of said sash from the closed position; and means for indicating the positions of said actuator.

9. The window of claim 8, wherein said second detent is provided on said actuator and said indicating means comprises a component which is movably by said second detent to assume a predetermined position in response to movement of said actuator to said operative position.

10. The window of claim 9, wherein said indicating means further comprises means for biasing said component from said predetermined position, said second detent including a cam face and said component having a portion which tracks said cam face and engages a predetermined portion of said cam face in the operative position of said actuator.

11. A window comprising a frame; a sash movable relative to said frame between open and closed positions; means for movably securing said sash to said frame; means for moving said sash relative to said frame, including a crank drive mounted on said frame and a lever pivotable by said crank drive; an arresting device having a mechanism for locking and unlocking said sash in the closed position; means for coupling said arresting device with said moving means to unlock said sash prior to movement of the sash from said closed portion and to lock said sash upon return movement to said closed position, including a motion transmitting member and means for articulately connecting said member with said lever and with said arresting device, said mechanism including at least one first detent on said frame, at least one second detent movably mounted on said sash, and an actuator connected with and movable by said motion transmitting member between operative and inoperative positions to respectively engage said second detent with and disengage said second detent from said first detent in the closed position of said sash, said crank drive being operable to move said actuator to said inoperative position by way of said lever and said member prior to moving said sash from the closed position and to move said sash back to closed position prior to moving said actuator to said operative position; and means for blocking said mechanism in response to movement of said sash from the closed position, including a blocking element which is provided on said sash and is movable to and from a blocking position in which said actuator is held in the inoperative position, said blocking element being moved from said blocking position by said frame in response to movement of said sash to said closed position so that said actuator can be moved by said drive to assume said operative position once the sash assumes said closed position.

12. The window of claim 11, wherein said sash comprises means for limiting the extent of movability of said element to and from said blocking position.

13. The window of claim 11, wherein said blocking means comprises a housing provided on or in said sash and movably receiving said blocking element, said element having a protuberance which extends from said housing and engages said frame while the sash approaches and continues to move toward said closed position whereby the frame moves said element from blocking position to permit a movement of said actuator to said operative position.

14. The window of claim 13, wherein said blocking means further comprises means for biasing said element to said blocking position so that said element is caused to assume such blocking position in automatic response to movement of said sash from said closed position as a result of disengagement of said protuberance from said frame.

15. The window of claim 14, wherein said biasing means comprises a spring which reacts against said housing and bears against said element.

16. The window of claim 14, wherein said biasing means comprises a torsion spring which is fulcrumed in said housing, said spring having a first portion which reacts against said housing and a second portion which bears against said element.

17. The window of claim 14, wherein said biasing means comprises at least one coil spring.

18. The window of claim 17, wherein said blocking element is reciprocable to and from said blocking position and said biasing means comprises a plurality of coil springs having axes extending in substantial parallelism with the direction of reciprocatory movement of said element.

19. The window of claim 11, further comprising a pin-and-socket connection between said actuator and said element in the blocking position of said element.

20. The window of claim 19, wherein said connection comprises a pin on said actuator and a socket in said element.

21. The window of claim 20, wherein said socket includes a slot having an open end facing said frame in the closed position of said sash.

22. The window of claim 21, wherein said element is movable in a predetermined direction to and from said blocking position and said slot extends in said direction.

23. The window of claim 20, wherein said socket includes a recess in said element.

24. A window comprising a frame; a sash member relative to said frame between open and closed positions; means for movably securing said sash to said frame; means for moving said sash relative to said frame, including a crank drive mounted on said frame and a lever pivotable by said crank drive; an arresting device having a mechanism for locking and unlocking said sash in the closed position; means for coupling said arresting device with said moving means to unlock said sash prior to movement of the sash from said closed position and to lock said sash upon return movement to said closed position, including a motion transmitting member and means for articulately connecting said member with said lever and with said arresting device, said mechanism including at least one first detent on said frame, at least one second detent movably mounted on said sash, and an actuator connected with and movably by said motion transmitting member between operative and inoperative positions to respectively engage said second detent with and disengage said second detent from said first detent in the closed position of said sash, said crank drive being operable to move said actuator to said inoperative position by way of said lever and said member prior to moving said sash from the closed position and to move said sash back to closed position prior to moving said actuator to said operative position; and means for blocking said mechanism in response to movement of said sash from the closed position, comprising a first pawl pivotably mounted in said sash and having a socket, a second pawl pivotably mounted in said sash and having a portion engageable by said frame during movement of said sash toward said closed position whereby the frame pivots said second pawl from a first to a second position, said actuator having a pin which is movably into and out of said socket in a first position of said first pawl so that said actuator is free to move to and from said operative position, said pawls having cooperating portions which maintain said first pawl in a second position in the first position of said second pawl and said blocking means further comprising means for biasing said pawls to said first positions.

25. The window of claim 24, wherein said first pawl is pivotable from said first to said second position thereof by said pin in response to movement of said actuator from said operative to said inoperative position and said portions of said pawls maintain said first pawl in said second position in the first position of said second pawl.

26. The window of claim 25, wherein said blocking means further comprises a housing for said pawls, said housing being provided in or on said sash and including a stop which is engaged by said first pawl under the action of said biasing means in the first position of said first pawl.

27. The window of claim 26, wherein said first pawl has an edge face which engages said stop in the first position of said first pawl.

28. The window of claim 24, wherein said pawls have retainers and said biasing means includes a coil spring having portions connected to said retainers.

29. A window comprising a frame; a sash movably relative to said frame between open and closed positions, said sash including a border which is adjacent said frame in the closed position of said sash; means for movably securing said sash to said frame; means for moving said sash relative to said frame; an arresting device having a mechanism for locking and unlocking said sash in the closed position; means for coupling said arresting device with said moving means to unlock said sash prior to movement of the sash from said closed position and to lock said sash upon return movement to said closed position; and means for blocking said mechanism in response to movement of said sash from the closed position, including a mobile blocking element and a housing for said blocking element, said housing being provided on said border.

30. A window of claim 29, wherein said housing is remote from said securing means.

31. A window comprising a frame; a sash movably relative to said frame between open and closed positions; means for movably securing said sash to said frame; means for moving said sash relative to said frame; an arresting device having a mechanism for locking and unlocking said sash in the closed position; means for coupling said arresting device with said moving means to unlock said sash prior to movement of the sash from said closed position and to lock said sash upon return movement to said closed position; means for blocking said mechanism in response to movement of said sash from the closed position, including a mobile blocking element for said mechanism, said blocking element being movable with said sash and being engaged and displaced from an extended position by said frame in the closed position of said sash; and means for adjusting the extended position of said blocking element.

32. The window of claim 31, wherein said adjusting means comprises a stop for said blocking element and means for adjusting said stop relative to said frame.

33. The window of claim 32, wherein said means for adjusting said stop includes means for locating said stop in any one of an infinite number of different positions.

34. The window of claim 33, wherein said locating means includes a rotary threaded member meshing with said frame.

35. The window of claim 32, wherein said means for adjusting said stop includes means for locating said stop in any one of a finite number of different positions.

36. The window of claim 35, wherein said locating means includes disengageable mating serrated or toothed sections one of which is provided on said stop and the other of which is provided on said frame.

37. The window of claim 32, wherein said means for adjusting the extended position of said blocking element further comprises a springy carrier for said stop, said carrier being provided on said frame.

* * * * *